United States Patent [19]

Chen et al.

[11] Patent Number: 5,004,076

[45] Date of Patent: Apr. 2, 1991

[54] APPARATUS FOR CONTROLLING AN ELECTRIC ELEVATOR

[76] Inventors: Hai C. Chen, 4F, No. 85, Chiang nan St., Nei hu, Taipei; Felix W. H. Yeh, No. 392, Yen pin St., Chia yi City, both of Taiwan

[21] Appl. No.: 339,981

[22] Filed: Apr. 18, 1989

[51] Int. Cl.[5] ..... B66B 3/00

[52] U.S. Cl. ..... 187/130; 187/131; 187/135

[58] Field of Search ..... 187/124, 130, 131, 135, 187/136, 137

[56] References Cited

U.S. PATENT DOCUMENTS

| | | | |
|---|---|---|---|
| 4,330,836 | 5/1982 | Donofrio et al. | 187/131 X |
| 4,400,786 | 8/1983 | Mandel et al. | 187/130 X |
| 4,711,324 | 12/1987 | Schroder | 187/135 |
| 4,724,933 | 2/1988 | Tsuji et al. | 187/137 |
| 4,872,532 | 10/1989 | Tobita et al. | 187/130 X |
| 4,874,063 | 10/1989 | Taylor | 187/13 X |

*Primary Examiner*—A. D. Pellinen
*Assistant Examiner*—W. E. Duncanson, Jr.
*Attorney, Agent, or Firm*—Fleit, Jacobson, Cohn, Price, Holman & Stern

[57] ABSTRACT

A controlling apparatus is provided to control an electric elevator in a more efficient manner. The controlling apparatus includes a motor controller for controlling the rotation of a driving motor of the elevator; a position detector for determining the current position of a cab and for generating a cab position signal; a load detector for determining the weight load of the cab and for generating a first weight load signal; cab calling means for generating a cab calling signal in response to the selection made on the cab calling means by a person or perople waiting to take the cab to arrive at a floor which they intend to go; cab status indicating means for indicating the current position, running direction and weight load of the cab; and system controlling means, coupled to the motor controller, the position detector, the load detector, the cab calling means and the cab status indicating means, for receiving the cab position signal from the position detector, the first weight load signal from the load detector, and the cab calling signal from the cab calling weight load generating one of a plurality of second weight load signals in accordance with the first weight load signal, for actuating the cab status indicating means to display the current position, running direction and weight load of the cab in accordance with the cab position signal and the one second weight load signal, and for enabling the motor controller to actuate the driving motor of the electric elevator in accordance with the cab calling signal.

10 Claims, 3 Drawing Sheets

APPARATUS FOR CONTROLLING AN ELECTRIC ELEVATOR

BACKGROUND OF THE INVENTION

The present invention relates generally to an apparatus for controlling a conveyor, and in particular to an apparatus for controlling an electirc elevator.

Electic elevators are generally mounted in buildings for the purpose of transferring people and/or goods from one floor of the building to another. A known type of electirc elevator has a cab for loading people and/or goods and a door provided on each of the floors of the building through which people get in or out of the cab. A displaying panel is usually provided above or beside the door to indicate the number of a floor on which the cab is at the current time and the direction in which the cab is running. The displaying panel of an electric elevator of a conventional type, however, cannot show the current weight load in the cab of the electric elevator. In most cases, people waiting to take the elevator cannot know whether or not the cab of the elevator which they are waiting for has reached its maximum load capacity until the cab arrives at the floor on which they are waiting. If the cab has reached its maximum load capacity, they must then decide another alternative, namely waiting for the next arrival of the cab, waiting for a different cab (if such alternative exists), or reaching the floor they intend to go by taking the stairs. A conventional elevator, designed and arranged to permit a full loaded cab to stop at a floor, to open and close its door although no one get in or out of the cab, is relatively inefficient and time consuming both for its passengers and for the people waiting to take the elevator. Additionally, an elevator operating in such a manner will also consume more electric power.

SUMMARY OF THE INVENTION

In view of the above-identified drawbacks existing in the operation of an electric elevator of the conventional type, the inventors of the present invention therefore submit a controlling apparatus for an electric elevator able to display the current weight load in the cab of an elevator to people waiting to take the elevator.

Another object of the present invention is to provide a controlling apparatus for an electric elevator which, upon its cab having reached its maximum load capacity, may provide an alert signal to all the display panels on each of the floors of the building in which the elevator combined with a controlling apparatus of the present invention is mounted, so that people waiting for the cab are allowed to decide in advance whether or not they will continue to wait for the cab by assessing its load; assessing if they were to enter the cab it may or may not reach its maximum load capacity.

A further object of the present invention is to provide a controlling apparatus for an electric elevator which may automatically accommodate the operation of the elevator in accordance with the weight load of the cab so that when the cab has reached its maximum load capacity, it will bypass any floor on which people are waiting for the cab and will stop at the nearest floor which one or more passengers in the cab intend to go.

In accordance with the present invention, an apparatus for controlling an electric elevator and to achieve the above-mentioned objects is provided. The electric elevator has a cab for loading people and/or goods, and an electirc motor for driving the cab to ascend and descend to one of the floors of a building into which the elevator is mounted. The apparatus for controlling the electric elevator includes a motor controller for controlling the rotation of the driving motor of the elevator and therefore controlling the movement of the cab; a position detector for determining the current position of the cab and for generating a cab position signal; a load detector for determining the weight load of the cab and for generating a weight load condition signal; cab calling means for generating a cab calling signal in response to the selection made on the cab calling means by a person or people waiting to take the cab to arrive to a floor which the person or people intend to go; cab indicating means for displaying its current position, running direction and weight load; and system controlling means, coupled to the motor controller, the position detector, the load detector, the cab calling means and the cab indicating means, for receiving the cab position signal from the position detector, the weight load condition signal from the load detector, and the cab calling signal from the cab calling means, for generating one of a plurality of load scale signals in accordance with the weight load condition signal, for actuating the cab indicating means to indicate its current position, running direction and current weight load of the cab in accordance with the cab position signal and the weight load signal, and for enabling the motor controller to actuate the driving motor of the electric elevator in accordance with the cab calling signal; whereby the current weight load of the cab may be indicated to a person or people waiting for the cab, enabling the person or people to know in advance whether or not the cab has a sufficient load capacity to carry the person or people in accordance with the indication of the cab indicating means.

Preferably, the load capacity indicating signals include an empty-load signal, a full-load signal, and at least one medium-load signal representing respectively an empty-load, a full-load, and at least one medium-load status of the cab. The cab status indicating means includes a multi-segment display panel which has an empty-load, a full-load, and at least one medium-load displaying segments which will each be activated in response respectively to the empty-load, the full-load, and the medium-load signals received from the system controlling means.

According to an alternative embodiment of the present invention, the controlling apparatus may further include sound generating means, coupled to the system controlling means, for generating a full-load sound signal in response to the full-load signal received from the system controlling means.

Preferably, according to a further embodiment of the present invention, the sound generating means may generate an empty-load sound signal, at least one medium-load sound signal and a full-load sound signal in response to the empty-load, the at least one medium-load and the full-load signals respectively.

Preferably, the sound generating means will include a voice synthesizer coupled to the system controlling means for generating the sound signals and a loudspeaker coupled to the voice synthesizer for outputting the synthetic sound signals received from the voice synthesizer.

BRIEF DESCRIPTION OF THE DRAWINGS

The present invention can be more fully understood by reference to the following description and accompanying drawings, which form an integral part of this application and which include.

DETAILED DESCRIPTION OF THE PREFERRED EMBODIMENTS

Figure 1:
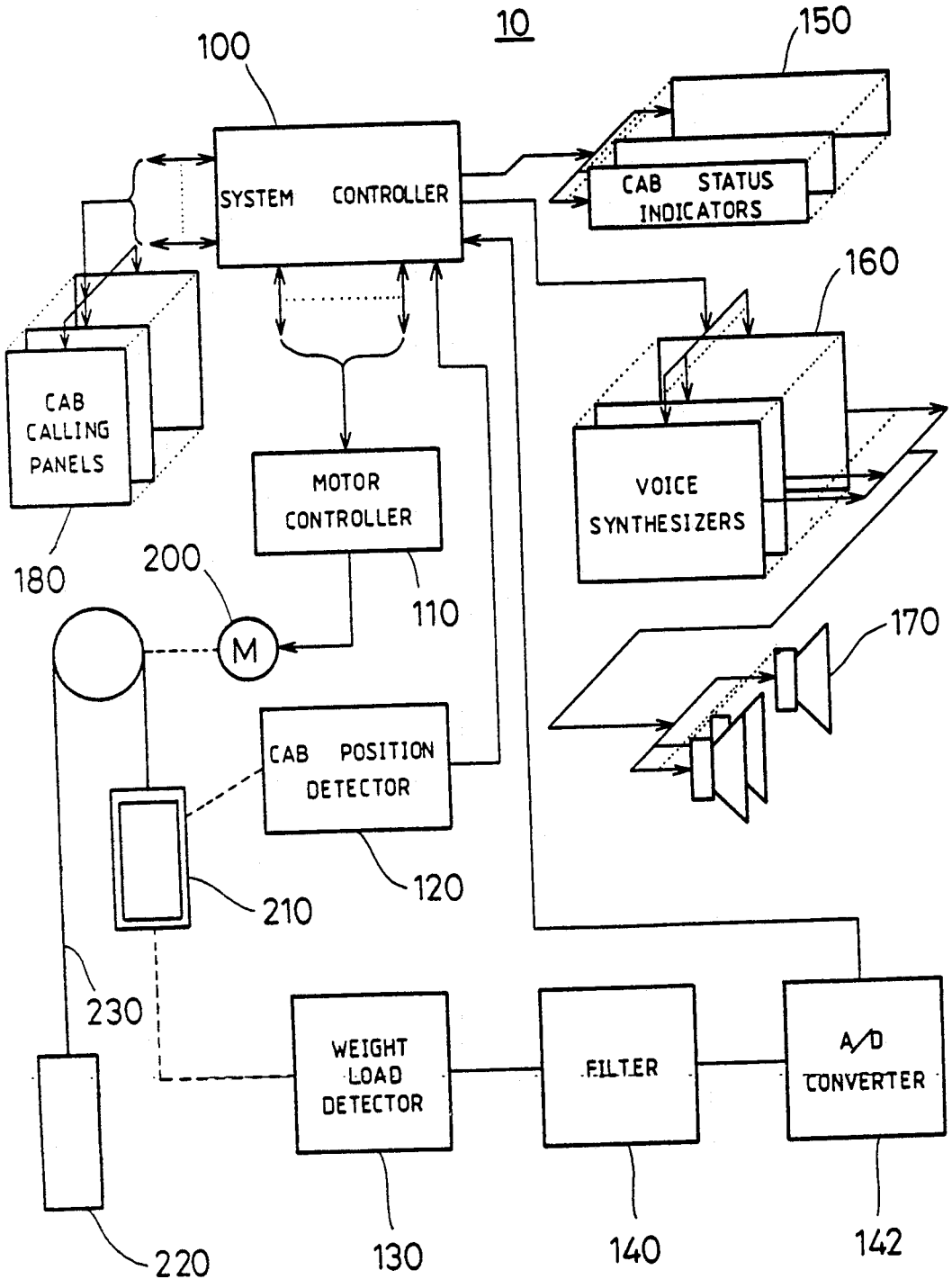
FIG. 1 shows a system block diagram of a controlling apparatus for an electric elevator according to a preferred embodiment of the present invention.

Referring to FIG. 1 of the drawings, a system block diagram of a controlling apparatus 10 constructed according to a preferred embodiment of the present invention is shown. As shown in FIG. 1, the controlling apparatus 10 includes a system controller 100. The motor controller 110 is coupled to the system controller 100 for controlling a motor 200 driving the cab 210 of an electric elevator mounted in a building. A cab position detector 120 is coupled to the system controller 100 for determining the current position of the cab 210 and for generating a cab position signal. A cab weight load detector 130 is also coupled to the system controller 100 for determining the current weight load of the cab 210 and for generating a cab weight load signal. A plurality of cab status indicators 150 are each coupled to the system controller 100 and mounted on each floor of the building and in the cab 210 to indicate the current position, weight load and running direction of the cab 210. Also, a plurality of cab calling panels 180 are each coupled to the system controller 100 and mounted in the cab 210 and on each floor of the building, for selecting the floor which one or more passengers in the elevator intend to go when taking the elevator and for calling the cab 210 respectively. In the above-mentioned arrangement, the technique for determining and indicating the direction in which the cab 210 is running is well known by a person skilled in the art, and thus a more detailed description thereto will not be provided herein.

The motor 200 drives a cable 230 connecting the cab 210 of the electric elevator to a counterweight 220 so the cab 210 may ascend or descend to arrive at one of the floors of the building for loading people and/or goods.

Upon receiving a cab calling signal sent from the cab calling panel 180, the system controller 100 enables the motor controller 110 to activate the motor 200 which then drives the cab 210 to ascend or descend to a floor selected via the cab calling panel 180 by a person or people. During the travel of the cab 210, the cab position detector 120 detects the current position of the cab 210 and sends a cab position signal to the system controller 100. The cab weight load detector 130 determines the magnitude of the load in the cab 210 and generates a weight load signal.

Preferably, the weight load detector 130 comprises a strain gage or a pressure transducer, such as a piezoelectric crystal (not shown in the drawings), which is preferably mounted in the bottom wall of the cab 210 and generates an analog voltage signal in approximately linear proportion to the magnitude of the load in the cab 210. The analog weight load signal generated by the weight load detector 130 is sent to the system controller 100 preferably through a filter 140 and an analog-to-digital (A/D) converter 142. The filter 140 filters out the unsteady state components in the weight load signal. The A/D converter 142 converts the filtered weight load siganl into a signal of digital type which is suitable to be received by the system controller 100. The system controller 100 determines the weight load in the cab 210, for example by utilizing a scale determining program, according to the weight load signal of digital type received from the A/D converter 142, and generates a weight load signal accordingly. The process in which the system controller 100 determines a weight load will be described in more detail hereinafter.

Figure 2:
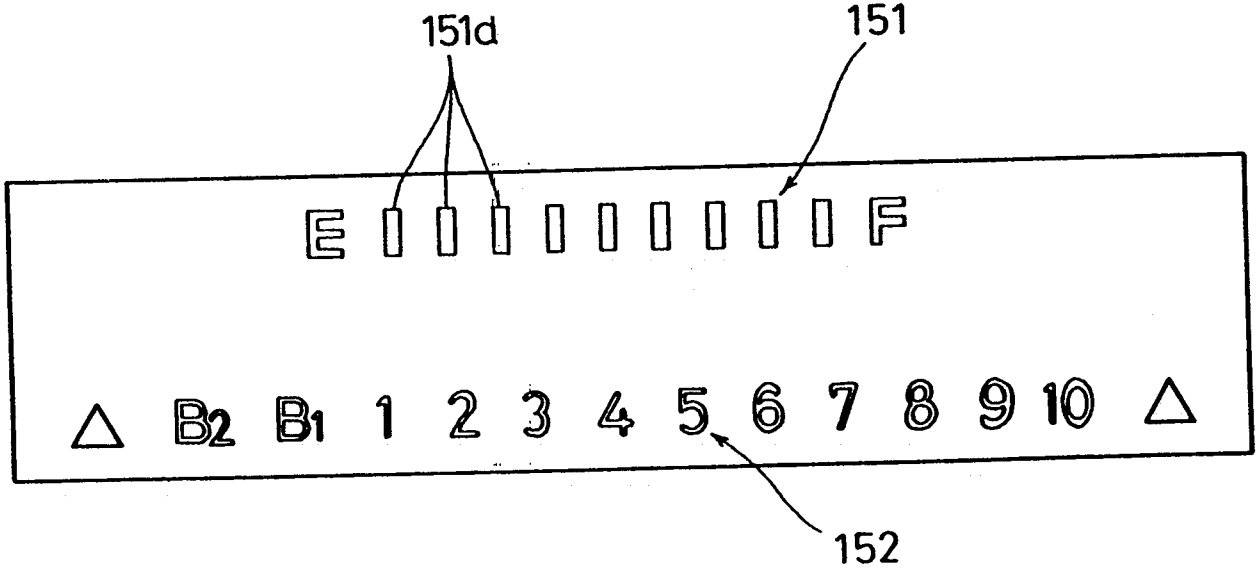
FIG. 2 illustrates a preferred arrangement for a cab status displaying panel suitably used in the controlling apparatus of the present invention and mounted above or beside an elevator door built on each floor of a building in which an electric elevator incorporated with a controlling apparatus of the present invention has been mounted.

FIG. 2 shows a preferred embodiment of a cab status indicator 150 which is in the form of a displaying panel. The displaying panel 150 has a cab weight load displaying area 151 and a cab position and direction displaying area 152. The arrangement and displaying operation of the displaying area 152 are the same as those of a conventional cab position indicator of a known elevator and no description thereto are further provided hereinafter.

The displaying area 151 includes a plurality of displaying segments each corresponding to one of the weight loads determined by the system controller 100. In particular and by way of example, a segment "E" represents a cab 210 empty-load weight, a segment "E" represents a cab 210 full-load weight, and a predetermined number of medium segments **151*a* each represents one of the medium-load weights of a number corresponding to the number of medium displaying segments 151*a*. For example, as shown in FIG. 2, there are nine medium displaying segments 151*a* representing nine medium-load weights of the load in the cab 210**.

In other words, when an empty-load is determined by the system controller 100 according to a weight load signal generated by the weight load detector 130, the segment "E" of the weight load displaying area 151 will be turned on by the system controller 100. When the weight load in the cab 210 increases, the segment "E" and corresponding ones of the medium displaying segments **151*a* will be turned on by the system controller 100 according to the weight loads determined by the system controller 100. For example, when the first of the nine medium-load weight loads is determined, the segment "E" and the first of the nine medium displaying segments 151*a* next to the segment "E" will be turned on; when the second weight load is determined by the system controller 100, the segment "E" and the first and second of the nine medium displaying segments 151*a* will be turned on and so on. When a maximum load capacity in the cab 210 is determined by the system controller 100, the segment "E", the nine medium displaying segments 151*a* and the segment "F" will all be turned on. Accordingly, by observing the cab weight load displaying area 151 of the displaying panel 150, the person or people waiting to take an elevator will be able to know in advance whether or not the cab 210** of the elevator has sufficient load space to carry them to their destination.

Preferably, when the segment "F" is turned on, the weight load of the cab 210 has reached the limit and it can no more withstand any additional load, such as the weight of an average person. That is, the weight load of the cab 210 at the occurence of a maximum laod capacity alert signal (the segments "E", "F" and the medium displaying segments 151*a* all turning on) is designed to be slightly smaller than the original weight load capacity of the cab 210.

Referring to both FIGS. 1 and 2, the operation of the controlling apparatus 10 will be described. After the initial start-up, the system controller 100 enables the cab position detector 120 to detect the current position of the cab 210, and enables indicators 150 to indicate the current position of the cab 210 according to the cab position signal generated by the detector 120. The cab weight load detector 130 is able to automatically detect the current magnitude of the weight load in the cab 210 and sends a cab weight load signal which arrives at the system controller 100 preferably through filter 140 and A/D converter 142. The controller 100 then determines the weight load in the cab 210 and generates a weight load signal which is used by indicators 150 to indicate the weight load on its displaying area 151. At any time, when a cab calling signal is present at the output of the cab calling panel 180 owing to the selection of one or more passengers waiting for the cab, the system controller 100 keeps the calling signal active and, before stopping on the floor from which the cab calling signal was sent, it determines whether or not the cab 210 can accommodate any more passengers and/or goods. If able, the controller 100 will permit the cab 210 to stop on the floor from which the calling signal was sent, during the ascending or descending travel of the cab 210, in order for its passenger/s to get in or out of the cab 210. If the cab 210 cannot accommodate an increased load, the system controller 100 will check whether or not one or more passengers in the cab 210 intend to get off on the floor from which the calling signal was sent. If one or more passengers intend to get off on the floor, the controller 100 then permits the cab 210 to stop on that floor in order for the one or more passengers to get in or out. If no passenger in the cab 210 intends to get off on the floor from which the calling signal was sent, the controller 100 will turn on all segments "E", 151*a* and "F" of the cab weight load displaying panels 150, and therefore urge the cab 210 to directly move to the nearest floor which is selected by one or more passengers in the cab 210, and ignore any calling signals from the floors which the cab 210 passes by during its travel. Therefore, the person or people waiting to take the elevator are able to decide in advance another alternative; namely waiting for the next arrival of the cab, waiting for a different cab (if such alternative is available) or other alternatives. By means of the arrangement and operation of the controlling apparatus 10 of the present above-described invention, people waiting for a cab may save time. Moreover, not only does this invention save the time of the passengers and the time of the people waiting, but in addition consumes less electric power.

According to another embodiment of the present invention, further provided in the controlling apparatus 10 of the present invention are a plurality of voice synthesizers 160 each mounted on each floor of the building and in the cab 210 and coupled to the system controller 100 for generating various kinds of predetermined synthetic sounds representing several kinds of cab conditions (more fully described hereinafter), and a plurality of loudspeakers 170 each mounted in the cab 210 and each floor of the building and coupled to one of the voice synthesizers 160 for outputting the synthetic sound signals generated by the voice synthesizers 160.

When the cab 210 has reached its maximum load capacity and the controller 100 has ascertained that no passengers will get off cab on the next floor, the system controller 100 may actuate a voice synthesizer 160 mounted on that floor to generate a synthetic sound, such as the message "the cab is full and will not stop at this floor" and the like, which is then outputted by a loudspeaker 170 coupled to the voice synthesizer 160 generating the synthetic sound identified above.

According to a further embodiment of the present invention, if there is more than one elevator mounted in the same building, the system controller 100 may enable a predetermined kind of music sound to be generated for a specific elevator by a voice synthesizer 160 of that elevator on a floor of the building, when the cab 210 of that elevator is detected to have reached that floor. A different kind of musical sound is generated for specific elevators. Therefore, blind people on a floor of the building can recognize by listening to the musical sounds of the cab of the elevator that it has reached the floor on which they are. A variety of kinds of synthetic sounds may be generated, for instance a synthetic piano music sound may be generated for the first elevator, and a synthetic violin music sound may be generated for the second elevator and so forth.

Furthermore, according to another embodiment of the present invention, the system controller 100 is designed to actuate a voice synthesizer 160 mounted on a floor to generate another predetermined synthetic sound when the cab position detector 120 detects that the cab 210 has reached that floor. For example, when the cab 210 reaches a floor datum point of the first floor of a building, the synthesizer 160 on the first floor is actuated by the system controller 100 to generate a short musical sound in "do" (the first note of scale in tonic sol-fa); when the cab 210 reaches a datum point of the second floor, the synthesizer 160 on the second floor is actuated to generate a short musical sound in "re" (the second note of scale in tonic sol-fa); when the cab 210 reaches a datum point of the third floor, the synthesizer 160 on the third floor is actuated to generate a short musical sound in "mi" (the third note of scale in tonic sol-fa) and so on. By means of the generation of synthetic musical note sounds in sequence, one or more passengers, particularly a blind person, may recognize the moving direction of the cab 210 and the number of the floor which the cab 210 has reached. It is to be understood that in the above-described embodiment, the use of short musical sounds in the form of notes of scale in tonic sol-fa is merely used by way of example as any sound or combination of sounds may be generated.

According to a further embodiment of the present invention, the different weight loads of the cab 210 may be represented by a series of predetermined synthetic musical sounds. That is, in addition to the indication of the multi-segment displaying area 151 of cab indicator 150, the system controller 100 enables the voice synthesizers 160 for a specific elevator to generate a series of predetermined musical sounds corresponding to the different weight loads. By way of an example, the eleven weight loads represented by the segments "E", "F" and the nine medium segments 151*a* of the cab weight load displaying area 151 shown in FIG. 2 may each be represented by one of a series of long musical sounds in "do" through "si" and high "do" through to high "si" respectively. In the exemplified case, the long musical sound in "do" represents an empty-load, and the long musical sound in "high fa" represents a full-load. It is to be understood that in the above-described embodiment, the use of long musical sounds in the form of notes of scale in tonic sol-fa is merely used by way of example as any sound or combination of sounds may be generated.

Figure 3:
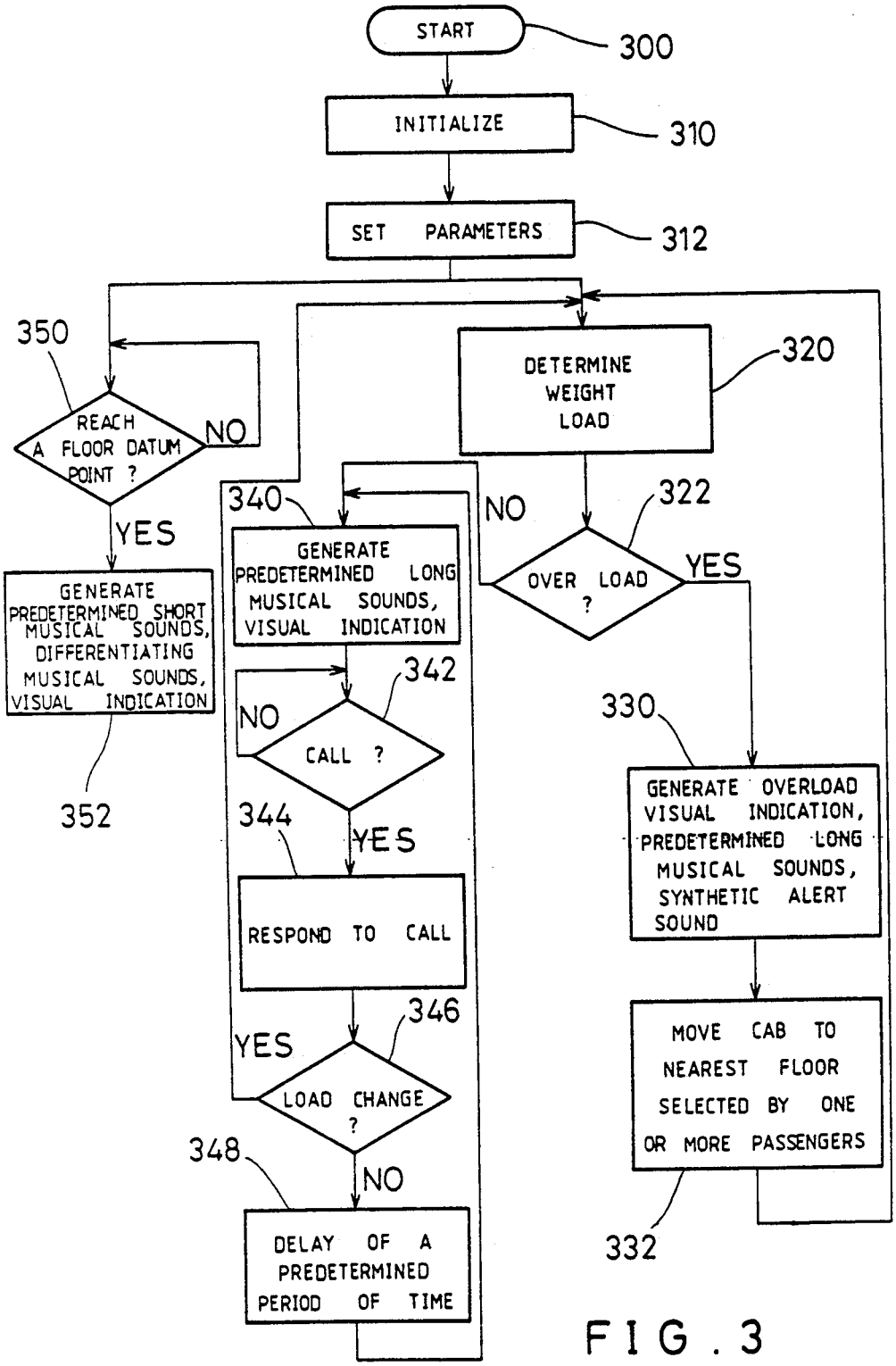
FIG. 3 shows a preferred flow chart for the controlling activity of a system controller used in the controlling apparatus of the present invention.

The flow of a control operation implemented in the system controller 100 is shown in FIG. 3. After starting up in block 300, the system controller 100 is initialized in block 310 and sets the system parameters in block 312. Then, the controller 100 determines the weight load of the cab 210 in block 320 according to a weight load signal sent from the detector 130 by utilizing a weight load scale determining program which can be readily prepared by a person skilled in programming with reference to the description herein, thus a detailed description will not be provided in the disclosure of the present invention herein.

According to the weight load determined in block 320, block 322 checks whether or not a full-load has been reached. If the cab 210 has reached its maximum load capacity, an overload indication is activated by block 330 to be shown on the displaying area 151 of each of displaying panels 150, and optionally a predetermined long musical sound signaling overload (such as a long "high fa"), and a synthetic alert sound (such as the message "the cab is full and will not stop on this floor"), are activated to be generated by the appropriate voice synthesizers 160. Block 322 ignores any cab calling signal sent from any calling panel 180 outside the cab and will cause the cab 210 to move to the nearest floor selected by one or more passengers in the cab. Then, the process goes back to block 320 to determine the weight load of the cab 210 once again.

If the cab 210 has not yet reached its maximum load capacity, block 340 enables the displaying area 151 of each of the displaying panels 150 to present a predetermined visual indication corresponding to the current weight load by turning on the proper displaying segments 151*a*, and enables the voice synthesizers 160 to generate a predetermined long musical sound (such as one in "do" through to "high mi"), representing the current weight load. In the following steps, block 342 checks whether or not there is a cab calling signal and, if such is the case, block 344 moves the cab 210 to the floor sending the calling signal in a conventional manner known to a person skilled in the field of elevator controlling art. Then, block 346 checks whether or not the magnitude of the load in the cab 210 has changed. If changed, the process goes back to block 320. If it has not changed, the process goes back to block 340 after a delay of a predetermined period of time (such as two seconds), in block 348.

Additionally, the system controller 100 determines whether or not the cab 210 has reached a floor datum point by repeatedly checking in block 350 the cab position signal sent from the position detector 120. When a floor datum point has been reached, block 352 enables a visual indication to be shown in the displaying area 152 of each of the displaying panels 150, and actuates the voice synthesizers 160 to generate a predetermined short musical sound representing the floor currently reached. Optionally, a predetermined synthetic musical sound for differentiating different elevators may also be activated to be generated by the voice synthesizers 160 in block 352.

The controlling process of the system controller 100 described above with reference to the flow chart shown in FIG. 3 is merely a feasible embodiment suitable to be adopted to embody the various aspects of the present invention. When the present invention is to be incorporated into an elevator system, many necessary modifications are apparent to those skilled in the art.

While the invention has been described in terms of what is presently considered to be the most practical and preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An apparatus for controlling an electric elevator having a cab adapted to load and transport people and/or goods to each of the floors of a building into which the elevator is mounted, and an electric motor for driving said cab to ascend and descend to said floors, said controlling apparatus comprising:

a motor controller for controlling the rotation of said driving motor of said elevator and therefore controlling the transfer of said cab from one floor of said building to another;

position detecting means for determining current position of said cab and for generating a cab position signal representing said current position;

load detecting means for determining the weight load of said cab and for generating a first weight load signal representing detected current weight load in said cab;

cab calling means for generating a cab calling signal in response to a selection made on said cab calling means by one or more people waiting to be transported by said cab to arrive on floor which said people intend to reach;

cab status indicating means for indicating current position, running direction and weight load of said cab; and system controlling means, coupled to said motor controller, said position detecting means, said weight load detecting means, said cab calling means and said cab status indicating means, for receiving said cab position signal from said position detecting means, said first weight load signal from said weight load detecting means, and said cab calling signal from said cab calling means, for generating in accordance with said first weight load signal one of a plurality of second weight load signals including at least one full-load signal, for actuating said cab status indicating means to indicate current position, running direction and weight load of said cab in accordance with said cab position signal and said one second weight load signal, and for enabling said motor controller to actuate the driving motor of the electric elevator in accordance with said cab calling signal;

whereby current condition of weight load in said cab may be presented to a person or people waiting for said cab who then may know in advance in accordance with the indication of said cab condition indicating means whether or not the cab has a sufficient weight load capacity to transfer him/her or them.

2. A controlling apparatus as claimed in claim 1, further comprising sound generating means coupled to said system controlling means for generating a predetermined kind of alert sound in response to said full-load scale signal received from said system controlling means.

3. A controlling apparatus as claimed in claim 2, wherein said sound generating means comprises:

at least one voice synthesizer coupled to said system controlling means for generating a predetermined alert signal in response to said full-load signal; and at least one loudspeaker coupled to said voice synthesizer for outputting said predetermined alert signal generated by said voice synthesizer.

4. A controlling apparatus as claimed in claim 1, wherein said weight load detecting means comprises a weight load detecting element selected from a group consisting of a strain gage and a pressure transducer, for generating said first weight load signal in an approximately linear proportion relationship to the magnitude of the physical weight load in the cab.

5. A controlling apparatus as claimed in claim 4, wherein said pressure transducer comprises a piezoelectric crystal.

6. A controlling apparatus as claimed in claim 4, wherein said weight load detecting means further comprises:

a filter coupled to said weight load detecting element for filtering said first weight load signal; and an analog-to-digital converter coupled between said filter and said system controlling means for converting said first weight load signal from an analog form to a digital form and for sending said first weight load signal in said digital form to said system controlling means.

7. A controlling apparatus as claimed in claim 2, wherein said system controlling means is further programmed to activate said sound generating means to generate a series of predetermined alert musical sounds of a first kind, each of said predetermined musical sounds of said first kind adapted to correspond to one of said plurality of second weight load signals generated by said system controlling means.

8. A controlling apparatus as claimed in claim 2, wherein said system controlling means is further programmed to activate said sound generating means to generate one of a series of predetermined musical sounds of a second kind in accordance with said cab position signal, each of said predetermined music sounds of said second kind adapted to represent one of the floors of the building.

9. A controlling apparatus as claimed in claim 2, wherein said system controlling means is further programmed to activate said sound generating means to generate a predetermined musical sound of a third kind for differentiating a specific elevator when said cab of said elevator is determined by said system controlling means to reach one of the floors of the building.

10. A controlling apparatus as claimed in claim 1, wherein said cab condition indicating means includes a multi-segment displaying panel coupled to said system controlling means, said displaying panel having a plurality of displaying segments each being activated in response to one of said plurality of second weight load signals generated by said system controlling means.

* * * * *